US009159513B2

(12) United States Patent
Moriyama et al.

(10) Patent No.: US 9,159,513 B2
(45) Date of Patent: Oct. 13, 2015

(54) ELECTROMAGNETIC RELAY

(75) Inventors: Satoshi Moriyama, Shinagawa (JP); Ryuji Sasaki, Shinagawa (JP); Katsuyuki Takahashi, Shinagawa (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 13/611,383

(22) Filed: Sep. 12, 2012

(65) Prior Publication Data

US 2013/0082806 A1 Apr. 4, 2013

(30) Foreign Application Priority Data

Sep. 30, 2011 (JP) ..... 2011-217841
Jun. 20, 2012 (JP) ..... 2012-138509

(51) Int. Cl.
*H01H 51/22* (2006.01)
*H01H 50/02* (2006.01)
*H01H 50/64* (2006.01)

(52) U.S. Cl.
CPC ..... *H01H 50/026* (2013.01); *H01H 50/642* (2013.01)

(58) Field of Classification Search
CPC ..... H01H 67/02; H01H 9/00
USPC ..... 335/78
See application file for complete search history.

(56) References Cited

U.S. PATENT DOCUMENTS

| | | | | |
|---|---|---|---|---|
| 4,958,137 | A * | 9/1990 | Schroeder | 335/128 |
| 5,202,663 | A * | 4/1993 | Tomono et al. | 335/86 |
| 5,396,204 | A * | 3/1995 | Matsuoka et al. | 335/78 |
| 5,568,108 | A * | 10/1996 | Kirsch | 335/130 |
| 5,757,255 | A * | 5/1998 | Noda et al. | 335/78 |
| 5,864,270 | A * | 1/1999 | Hoffman | 335/78 |
| 5,969,586 | A * | 10/1999 | Noda et al. | 335/83 |
| 6,034,582 | A * | 3/2000 | Fausch | 335/78 |
| 6,486,760 | B2 * | 11/2002 | Miyazaki et al. | 335/78 |
| 6,606,018 | B2 * | 8/2003 | Takano et al. | 335/78 |
| 6,903,638 | B2 * | 6/2005 | Nakamura et al. | 335/78 |
| 7,994,884 | B2 * | 8/2011 | Kuo | 335/78 |
| 2005/0057332 | A1 * | 3/2005 | Nakamura et al. | 335/128 |
| 2006/0279384 | A1 * | 12/2006 | Takayama et al. | 335/78 |
| 2008/0048808 | A1 * | 2/2008 | Kozai et al. | 335/203 |
| 2009/0322453 | A1 * | 12/2009 | Kawaguchi et al. | 335/81 |

FOREIGN PATENT DOCUMENTS

JP 2008-210776 9/2008

* cited by examiner

*Primary Examiner* — Shawki S Ismail
*Assistant Examiner* — Lisa Homza
(74) *Attorney, Agent, or Firm* — Staas & Halsey LLP

(57) ABSTRACT

An electromagnetic relay includes a contact including a movable spring having a base end fixed to a bottom of a housing and a tip end provided with a movable contact, and a fixed spring having a base end fixed to the bottom of the housing and a tip end provided with a fixed contact. The movable contact is provided opposite to the fixed contact so as to come in contact with the fixed contact or move away therefrom. The housing has a protrusion protruding toward a side of the fixed contact opposite to a side facing the movable contact.

16 Claims, 10 Drawing Sheets

ELECTROMAGNETIC RELAY

CROSS-REFERENCE TO RELATED APPLICATIONS

This application is based upon and claims the benefit of priority of the prior Japanese Application No. 2011-217841, filed Sep. 30, 2011 and Japanese Application No. 2012-138509 filed Jun. 20, 2012, the entire contents of both are incorporated herein by reference.

BACKGROUND OF THE INVENTION

1. Field of the Invention

This invention relates to an electromagnetic relay.

2. Description of the Related Art

An electromagnetic relay which includes an electromagnet, an actuator which is actuated in response to a magnetic action of the electromagnet, a contact which opens and closes in response to the actuation of the actuator, and a housing for accommodating the electromagnet, the actuator and the contact is known (See JP 2008-210776 A.).

There is a need for an electromagnetic relay with improved reliability of an opening and closing operation of a contact part.

SUMMARY OF THE INVENTION

According to one embodiment, an electromagnetic relay is provided, the electromagnetic relay comprising: an electromagnet; an actuator which is actuated in response to a magnetic action of the electromagnet; a contact which opens and closes in response to the actuation of the actuator; and a housing for accommodating the electromagnet, the actuator and the contact, wherein the contact includes a movable spring having a base end fixed to a bottom of the housing and a tip end provided with a movable contact, and a fixed spring having a base end fixed to the bottom of the housing and a tip end provided with a fixed contact, the movable contact being provided opposite to the fixed contact and being moved in response to the actuation of the actuator, coming in contact with the fixed contact or moving away from the fixed contact, and wherein the housing has a protrusion protruding toward a side of the fixed contact opposite to a side facing the movable spring.

DETAILED DESCRIPTION

Figure 1:
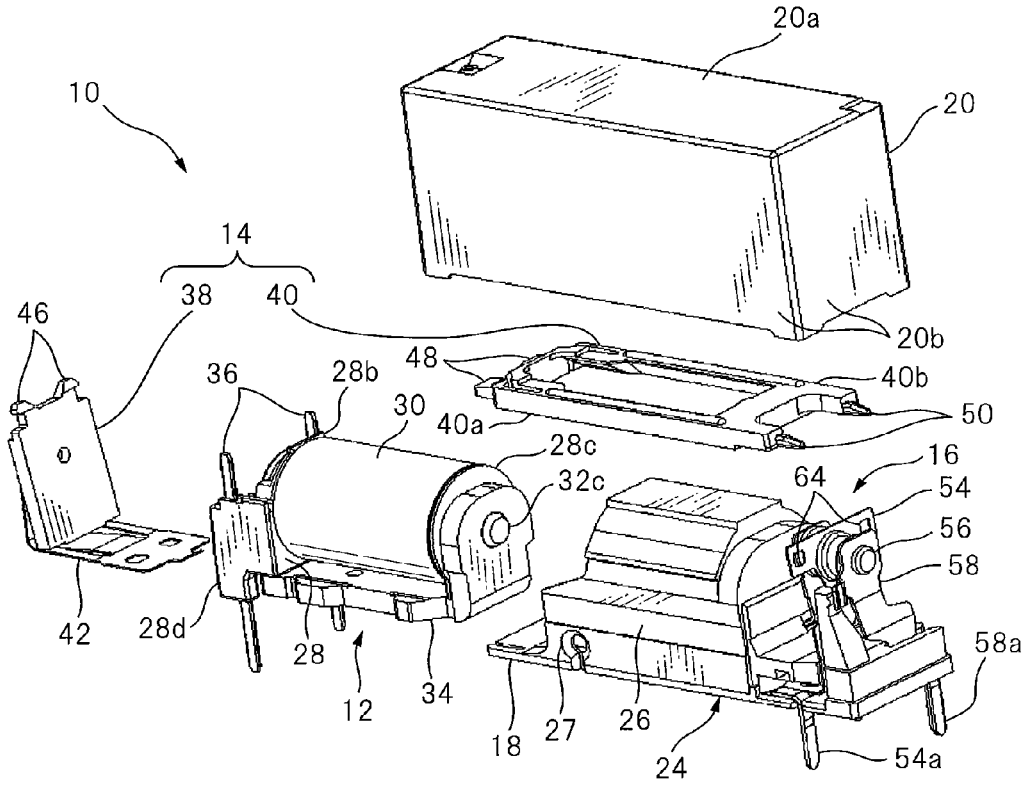
FIG. 1 is an exploded perspective view illustrating an electromagnetic relay according to a first embodiment.

Embodiments will be described below with reference to the drawings. Like elements commonly used in different embodiments or variants thereof are designated with the same reference numerals. For the purpose of clarifying the drawings, the size of one element in relation to another may be modified accordingly. Although a position of one element in relation to another or an orientation for fitting one element in relation to another may be specified in the following description, such particularities are not intended to limit the practical application or the configuration of the present invention, but merely based on the illustrated exemplary drawings, unless otherwise stated.

Figure 2:
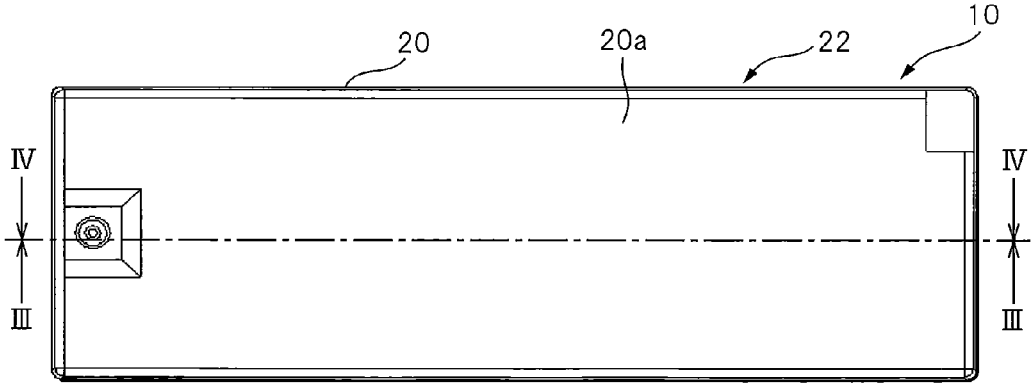
FIG. 2 is a plan view illustrating the electromagnetic relay according to the first embodiment.
Figure 3:
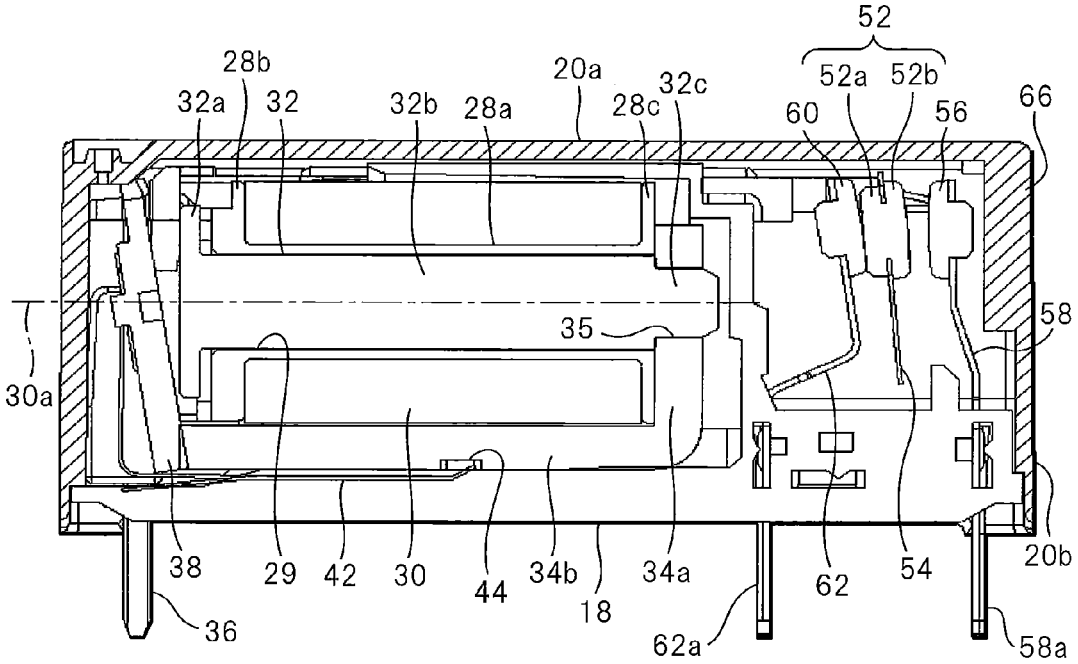
FIG. 3 is a sectional view along an alternate short and long dash line in FIG. 2, taken in the direction III-III.
Figure 4:
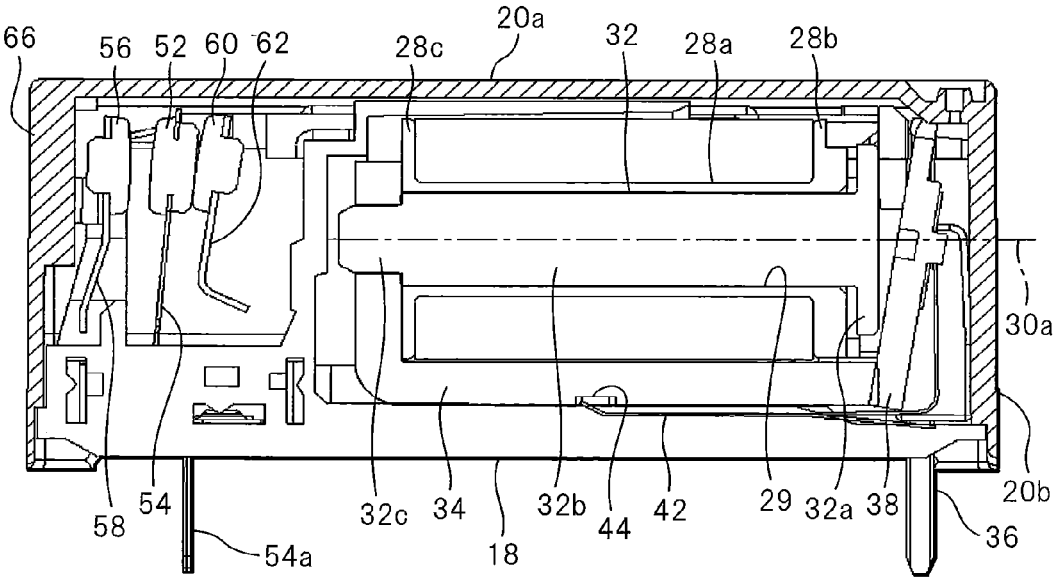
FIG. 4 is a sectional view along an alternate short and long dash line in FIG. 2, taken in the direction IV-IV.

Referring to FIGS. 1 to 4, an electromagnetic relay 10 according to a first embodiment will be described. FIG. 1 is an exploded perspective view illustrating the electromagnetic relay 10, FIG. 2 is a plan view illustrating the electromagnetic relay 10, FIG. 3 is a sectional view along an alternate short and long dash line in FIG. 2, taken in the direction III-III, and FIG. 4 is a sectional view along the alternate short and long dash line in FIG. 2, taken in the direction IV-IV.

The electromagnetic relay includes an electromagnet part 12, an actuator part 14 which is actuated in response to a magnetic action of the electromagnet part 12, and a contact part 16 which opens and closes in response to the actuation of the actuator 14. The electromagnetic relay 10 also includes a housing 22 which has a base 18 and a cover 20, both of which are made of molding resin having an electrical insulation property. The base 18 has a bottom face 24 defining a bottom of the housing 22 and a base block 26 substantially having a tubular shape for electrically insulating the electromagnet part 12 from the contact part 16. The cover 20 has a top wall 20*a* and a peripheral wall 20*b* extending downward in a vertical direction from a peripheral edge of the top wall 20*a*. The top wall 20*a* and the peripheral wall 20*b* define a void space with an opening facing downward. The void space defined by the cover 20 has the sizes corresponding to those of the bottom face 24 of the base 18 in a longitudinal direction and a width direction. Thus, the cover 20 and the base 18 can be assembled into the housing 22 of the electromagnetic relay 10 which substantially defines a closed space in the interior thereof. Each component of the electromagnet part 12, of the actuator part 14 and of the contact part 16 is accommodated in the interior of the housing 22.

An injection hole 27 is formed in a side surface of the base block 26 in the vicinity of the bottom thereof. In an assembling process, which is not described in further details, adhesive can be applied into the base block 26 through the injection hole 27 to adhere a yoke 34 in position.

The electromagnet part 12 includes a spool 28 substantially having an H-shape in side view and made of molding resin with an electrical insulation property, a coil 30 formed by winding a conductive wire around a body portion 28*a* of the spool 28, a core 32 having a columnar shape extending along a central axis 30*a* of the coil 30 and made of a magnetic material and, and a yoke 34 coupled to the core 32 to extend a magnetic path. The spool 28 has the body portion 28*a* having a tubular hollow shape, and a pair of flanges 28*b* and 28*c* extending from both ends of the body portion 28*a* substantially in the vertical direction. A through hole 29 is formed in the spool 28 as illustrated in FIGS. 3 and 4, extending through the body portion 28*a* and the flanges 28*b* and 28*c*. The spool 28 also has a pair of extended portions 28*d* which extend in a longitudinal direction (a longer direction of the electromagnetic relay 10), from both ends of the flange 28*b* in a width direction (a shorter direction of the electromagnetic relay, i.e., an upward and downward direction in FIG. 2). A through hole (not shown) extending in the vertical direction is formed in each extended portion 28*d*, and coil terminals 36 are fitted to the extended portion 28*d* via the through hole. Both ends of the conductive wire of the coil 30 are fixed to the pair of the coil terminals 36. In this way, when a certain electric voltage is applied between the coil terminals 36, electric power is supplied to the coil 30, exciting the coil 30 to act as an electromagnet.

The core 32 has a flange 32*a* extending along the flange 28*b* of the spool 28 in the vertical direction, a body 32*b* extending through the through hole 29 of the spool 28, and a tip 32*c* having a small diameter than the body 32*b*. The tip 32*c* of the core 32 protrudes toward an inner surface of the base block 26 through the through hole 29 formed in the flange 28*c*.

The yoke 34 made of a magnetic material is a plate substantially having an L-shape in side view and bent along a lower end of the flange 28*c* of the spool 28. The yoke 34 includes a vertical plate 34*a* extending along an outer surface of the flange 28*c* of the spool 28 in the vertical direction, and a lateral plate 34*b* extending substantially in parallel to the central axis 30*a* of the coil 30 from a lower end of the vertical plate 34*a* to the vicinity of the flange 32*a* of the core 32. An attachment hole 35 is formed in the vertical plate 34*a* of the yoke 34 in order to receive the tip 32*c* of the core 32. The yoke 34 and the core 32 are fixed together by means of caulking, for example, with the tip 32*c* of the core 32 inserted through the attachment hole 35 of the yoke 34.

The actuator part 14 includes an armature 38 which pivots in response to a magnetic action of the electromagnet part 12, and a card 40 which moves in parallel to the central axis 30*a* of the coil 30 in response to the pivoting movement of the armature 38. The armature 38 is substantially a rectangular plate provided via a hinged spring 42 at a certain angle relative to the flange 32*a* of the core 32. The hinged spring 42 is at one end attached to the armature 38 and at the other end engaged with the yoke 34. Specifically, the other end of the hinged spring 42 extends through a groove formed on the base 18 and is engaged with a cut-off portion 44 formed on the bottom surface of the lateral plate 34*b* of the yoke 34, as illustrated in FIGS. 3 and 4. In this manner, the hinged spring 42 is provided to bias the armature 38 in a direction away from the flange 32*a* of the core 32. Thus, when no electricity is supplied to the coil 30 as illustrated in FIGS. 3 and 4, the armature 38 is at a greater angle relative to the flange 32*a* of the core 32. Then, when a certain voltage is applied to the coil 30 through the coil terminals 36, the armature 38 is attracted toward the flange 32*a* of the core 32 against the biasing force by the hinged spring 42, due to magnetic force generated by the electromagnet part 12. In this way, the armature 38 pivots such that the angle relative to the flange 32*a* of the core 32 decreases. When the electricity supplied to the coil 30 is cut again, the armature 38 returns to a position as illustrated with the aid of the biasing force of the hinged spring 42. The pivoting movement of the armature 38 causes the contact part 16 to open and close.

The armature 38 has at its upper end a pair of protrusions 46 which protrude upward from both ends of the armature 38 in its width direction. The protrusions 46 are provided at an angle relative to each other, forming a gap therebetween which is greater at its tip than at its base. The card 40 is a rectangular frame made of resin, for example, with a pair of hooks 48 protruding outward from a first edge 40*a* in its longitudinal direction. The hooks 48 of the card 40 are slanted inwardly such that its tips are closer to each other than its bases, allowing the hooks 48 to be engaged with the protrusions 46. In cooperation of the protrusions 46 and the hooks 48, the pivoting movement of the armature 38 is transmitted to the card 40, allowing the card 40 to move in parallel to the longitudinal direction of the electromagnetic relay 10. The card 40 also has a pair of acting portions 50 which protrude outwardly from a second edge 40*b* of the card 40 opposite to the first edge 40*a*. The acting portions 50 are brought into engagement with through holes 64 formed in a movable spring 54, allowing a movable contact 52 of the movable spring 54 to move toward a fixed make contact 56.

The contact part 16 includes a movable spring 54 carrying a movable contact 52 which moves in response to the movement of the card 40, a fixed make spring 58 provided opposite to the movable spring 54 and carrying a fixed make contact 56, and a fixed break spring 62 provided opposite to the movable spring 54 on the opposite side of the fixed make spring 58 and carrying a fixed break contact 60. The movable spring 54 can be fixed by inserting its base end to a groove (not shown) formed in the base 18. The movable contact 52 provided at a tip end of the movable spring 54 includes a first contact 52*a* opposite to the fixed break contact 60 and a second contact 52*b* opposite to the fixed make contact 56. The movable spring 54 has a wider portion in the periphery of the movable contact 52, and a pair of through holes 64 are formed in both sides of the wider portion of the movable contact 52 (FIG. 1). The movable spring 54 has at its base end a movable terminal 54*a* extending downward to the outside through the base 18 (FIG. 4).

The fixed make spring 58 can be fixed by inserting its base end to a groove (not shown) formed in the base 18. The fixed make spring 58 has at its base end a fixed make terminal 58*a* extending downward to the outside through the base 18 (FIG. 3). The fixed break spring 62 can be fixed by inserting its base end to a groove (not shown) formed in the base 18. The fixed break spring 62 has at its base end a fixed break terminal 62*a* extending downward to the outside through the base 18 (FIG. 3). The movable terminal 54*a*, the fixed make terminal 58*a* and the fixed break terminal 62*a* are spaced apart from one another such that they do not inadvertently come in contact with or interfere with one another.

When no electricity is supplied to the electromagnet part 12, the movable contact 52 is in contact with the fixed break contact 60 as illustrated. In this state, the movable contact 52 is biased against the fixed break contact 60 by means of the movable spring 54 functioning as a spring. When electricity is supplied to the electromagnet part 12, the actuator part 14 is actuated as described above, and the card 40 presses the movable spring 54 toward the fixed make spring 58 against biasing force of the movable spring 54. As a result, the movable contact 52 moves away from the fixed break contact 60, and come in contact with the fixed make contact 56 on the opposite side of the fixed break contact 60. When the electricity is cut again, due to elasticity of the movable spring 54, the contact part 16 returns to a state as illustrated, which is the state before the electricity is supplied. In this way, the electromagnetic relay 10 allows the contact part 16 to open and close.

Accordingly, this type of the electromagnetic relay 10 makes use of the movable spring 54 which functions as an elastically derormable spring, switching from a conducting state to conduct electricity to a blocking state to block electricity, or vice versa, between the movable contact 52 and the fixed break contact 60 and between the movable contact 52 and the fixed make contact 56. Thus, the distance between the contacts may be designed within such a range that the switching operation of the contacts can be smoothly carried out with rated electric power. For example, if the fixed make spring 58 is subject to plastic deformation, forming a wider gap between the movable contact 52 and the fixed make contact 56, it could be the case where it is not possible or barely possible for the movable contact 52 to come in contact with the fixed make contact 56 even when it is moved toward the fixed make contact 56. Therefore, in this embodiment, the cover 20 has on its inner surface a protrusion 66 protruding toward the fixed make contact 56. The protrusion 66 extends over an area such that the fixed make contact 56 comes in contact with the protrusion 66, as the fixed make contact 56 is moved toward the inner surface of the cover 20, as shown in FIGS. 3 and 4. The size of the protrusion 66 protruding toward the fixed make contact 56 is designed such that the fixed make contact 56 comes in contact with the protrusion 66 within a range that allows the fixed make spring 58 to be elastically deformed, in order to prevent the fixed make spring 58 from being plastically deformed.

The size of the protrusion 66 protruding toward the fixed make contact 56 may also be designed such that in a state where the movable contact 52 is in contact with the fixed make contact 56 (i.e., a state where the electromagnet part 12 has been excited), a side of the fixed make contact 56 opposite to the side facing the movable contact 52 comes in contact with the protrusion 66. In this case, when the movable contact 52 is pressed against the fixed make contact 56, no gap is formed between the fixed make contact 56 and the protrusion 66. This configuration allows the protrusion 66 to absorb unexpected impact thereon caused by, e.g., the electromagnetic relay 10 falling down. Accordingly, the fixed make spring 58 can be prevented from being plastically deformed.

Figure 5:
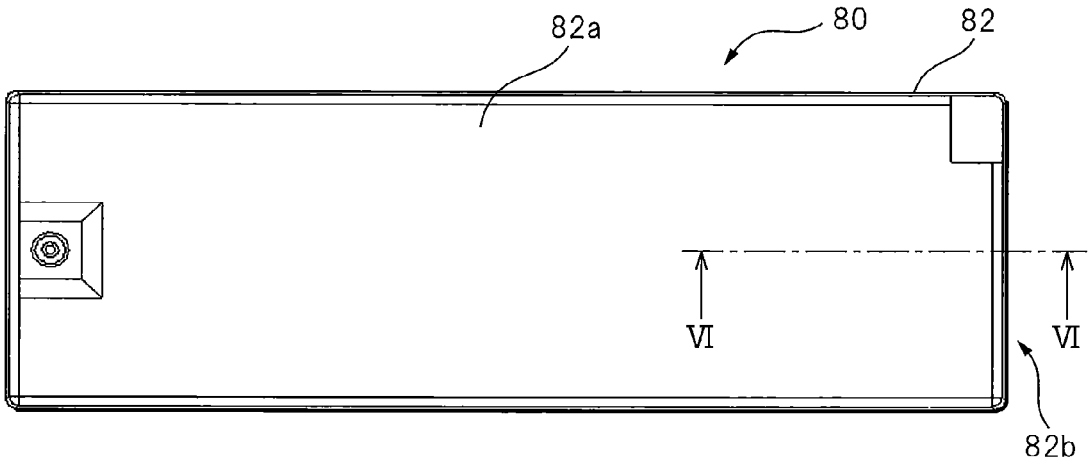
FIG. 5 is a plan view illustrating an electromagnetic relay according to a variant of the first embodiment.
Figure 6:
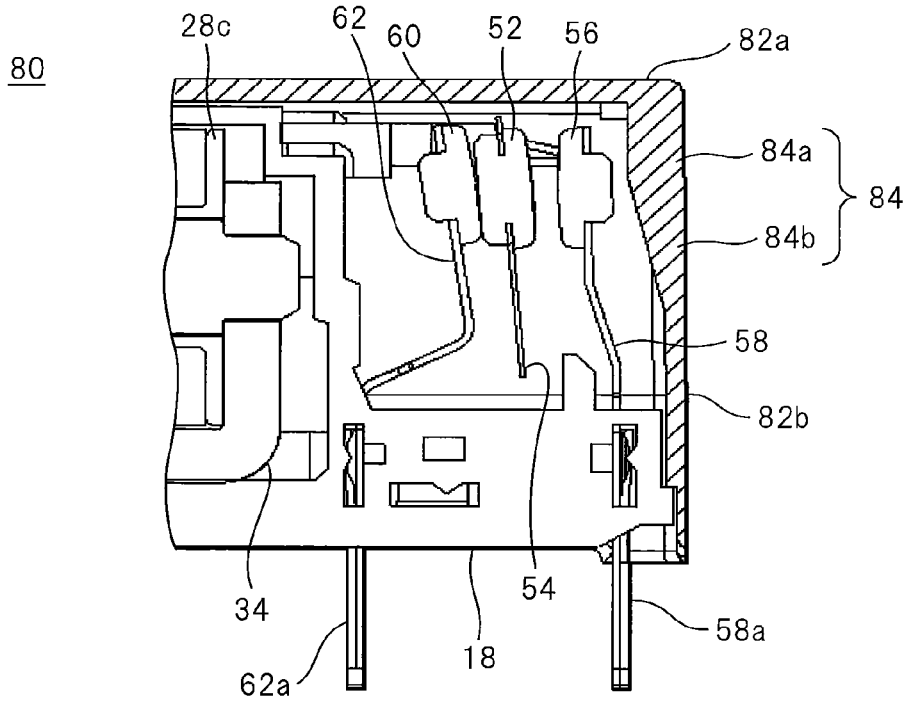
FIG. 6 is a partial sectional view along an alternate short and long dash line in FIG. 5, taken in the direction VI-VI.

Next, an electromagnetic relay 80 according to a variant of the first embodiment will be described with reference to FIGS. 5 and 6. FIG. 5 is a plan view illustrating the electromagnetic relay 80, and FIG. 6 is a partial sectional view along an alternate short and long dash line in FIG. 5, taken in the direction VI-VI. In the following description on various variants and embodiments, matters that have already been described in relation to the above embodiment will be omitted.

The electromagnetic relay 80 according to this variant includes a cover 82 having a top wall 82*a*, a peripheral wall 82*b* extending from a peripheral edge of the top wall 82*a*, and a protrusion 84 formed on an inner surface of the peripheral wall 82*b*. The protrusion 84 has a limiting portion 84*a* which protrudes toward the fixed make contact 56 to the extent that prevents the fixed make spring 58 from being plastically deformed. The protrusion 84 also has a slanted portion 84*b* which extends from a lower end of the limiting portion 84*a* and becomes gradually thinner toward a lower end thereof. The lower end of the slanted portion 84*b* extends continuously to the peripheral wall 82*b*. In this variant, the protrusion 84 has a slanted inner surface on the slanted portion 84*b*. This configuration prevents the lower end of the protrusion 84 from coming in contact with the fixed make spring 58 by accident during a process of attaching the cover 82 to the base 18. In other words, since the protrusion 84 has the slanted portion 84*b* which is slanted such that the protrusion 82 becomes gradually thinner toward the lower end thereof in a direction in which the cover 82 is attached to the base 18, a process of assembling the cover 82 and the base 18 together is smoothly carried out. In the illustrated variant, the slanted portion 84*b* terminates near the middle of peripheral wall 82*b* of the cover 82. However, the slanted portion 84*b* may be lengthened or shortened by changing an angle of inclination, depending on the shapes of components such as the fixed make spring 58 or the shape of the base 18.

Figure 7:
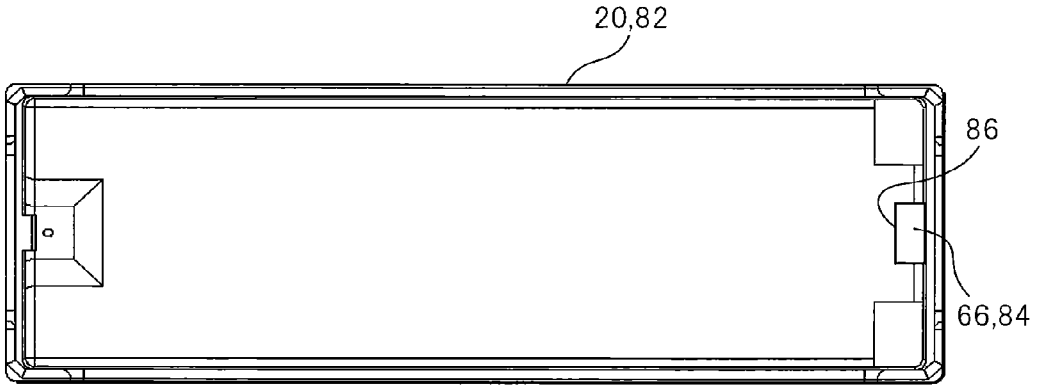
FIG. 7 is a bottom view illustrating a cover of the electromagnetic relay according to the first embodiment.

FIG. 7 is a bottom view illustrating the cover 20 or 82 of the electromagnetic relay 10 or 80 according to the first embodiment. The protrusion 66 or 84 in this embodiment has a flat surface 86 opposite to the fixed make contact 56. Since it is inexpensive to produce such a protrusion 66 or 84, the electromagnetic relay 10 or 80 can also be inexpensive.

Figure 8:
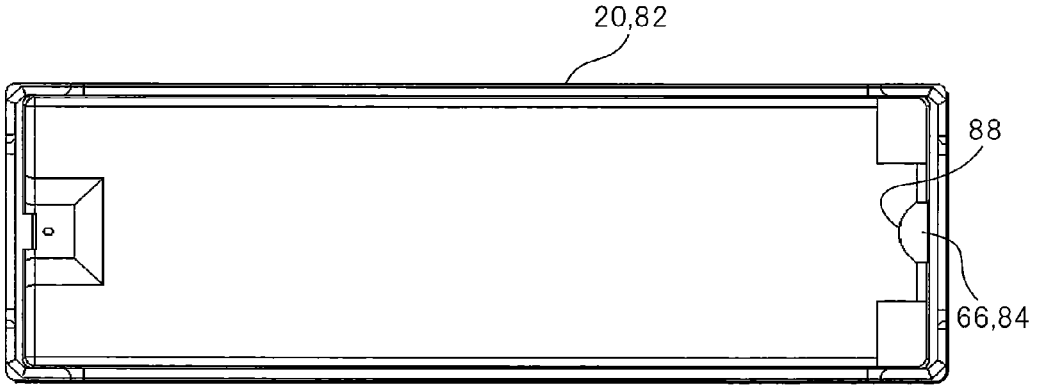
FIG. 8 is a bottom view illustrating a cover of the electromagnetic relay according to another variant of the first embodiment.

FIG. 8 is a bottom view illustrating the cover 20 or 82 of an electromagnetic relay according to another variant of the first embodiment. The protrusion 66 or 84 in this embodiment has a surface 88 opposite to the fixed make contact 56 and the surface 88 has an arc-shape protruding toward the fixed make contact 56. With such an arc-shaped surface 88, even when the fixed make spring 58 is twisted, for example, which makes difficult for the fixed make contact 56 to come in contact with the surface 88 of the protrusion 66 or 84 in a face-to-face manner, the fixed make spring 58 can be prevented from being plastically deformed. In other words, the arc-shaped surface 88 allows the fixed make contact 56 to come in contact with the protrusion 66 or 84 in any direction, enhancing reliability of an opening and closing operation of the contact part.

Figure 9:
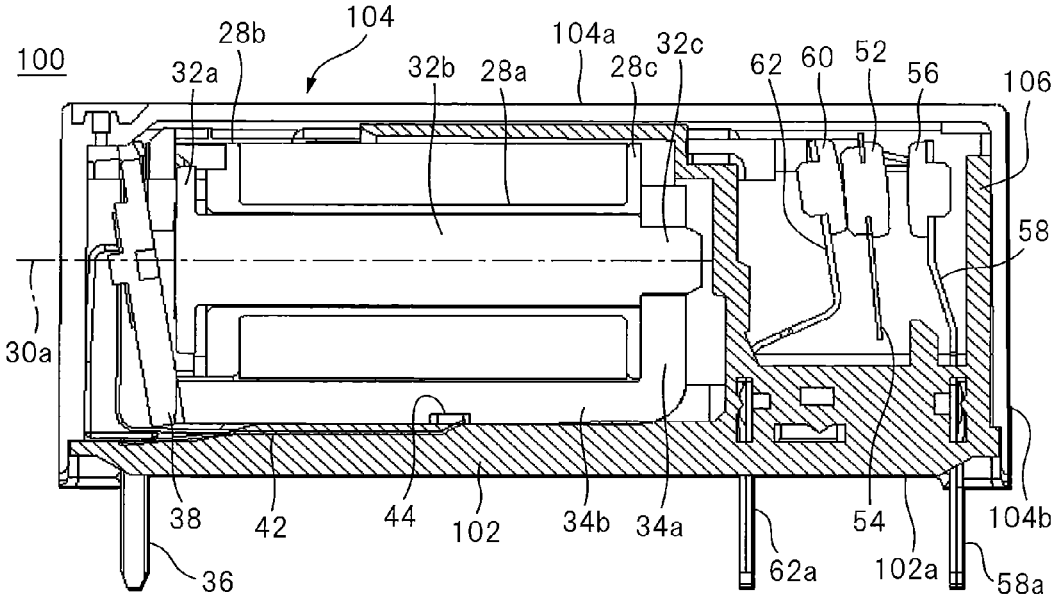
FIG. 9 is a sectional view illustrating an electromagnetic relay according to a second embodiment, corresponding to FIG. 3.

Referring to FIG. 9, an electromagnetic relay 100 according to a second embodiment will be described. FIG. 9 is a sectional view illustrating the electromagnetic relay 100, corresponding to FIG. 3. In this embodiment, the electromagnetic relay 100 includes a cover 104 having a top wall 104*a* and a peripheral wall 104*b* in the same manner as a conventional type. In FIG. 9, a base 102 illustrated with hatching has a base protrusion 106 extending upward from an edge 102*a* at which the fixed make contact 56 is situated, along an inner surface of the peripheral wall 104*b* of the cover 104. The size of the base protrusion 106 protruding from the peripheral wall 104*b* toward the fixed make contact 56 is designed such that the base protrusion 106 can achieve the same effect as the protrusion 66 or 84 in the first embodiment. Accordingly, the electromagnetic relay 100 in the present embodiment also prevents the fixed make spring 58 from being plastically deformed, maintaining reliability of an opening and closing operation of the contact part.

Figure 10:
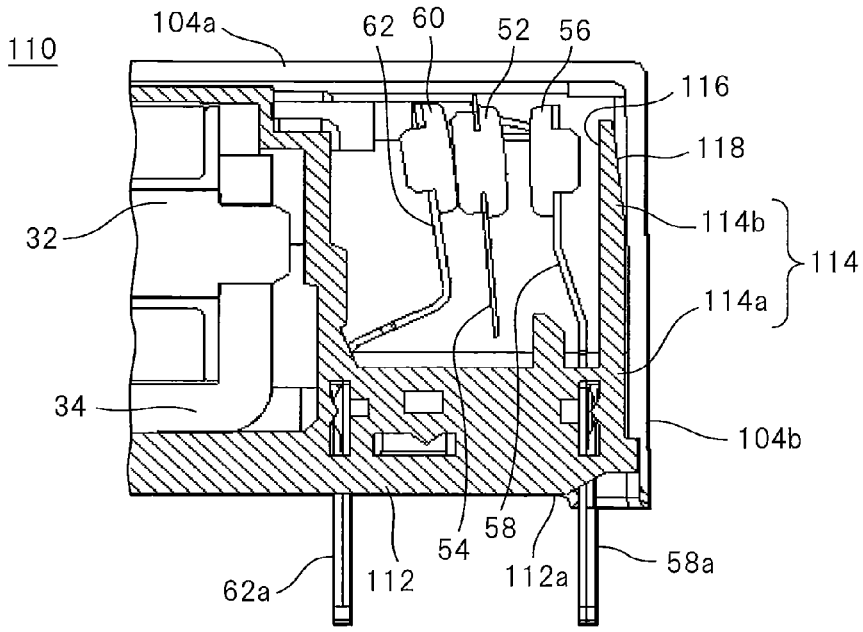
FIG. 10 is a partial sectional view illustrating an electromagnetic relay according to a variant of the second embodiment, corresponding to FIG. 6.

FIG. 10 is a partial sectional view illustrating an electromagnetic relay according to a variant of the second embodiment, corresponding to FIG. 6. The electromagnetic relay 110 according to this variant includes a cover 104 having a top wall 104*a* and a peripheral wall 104*b* in the same manner as a conventional type. A base 112 illustrated with hatching in FIG. 10 has a base protrusion 114 extending upward from a base edge 112*a* at which the fixed make contact 56 is situated, along an inner surface of the peripheral wall 104*b* of the cover 104. The base protrusion 114 has a flat plate portion 114*a* extending upward from the base edge 112*a*, and a slanted portion 114*b* having a slanted surface 118 such that the slanted portion 114*b* becomes gradually thinner from an upper end of the flat plate portion 114*a* toward an end thereof. The slanted surface 118 of the slanted portion 114*b* extends on a side of the base protrusion 114 opposite to a surface 116 facing the fixed make contact 56. The slanted portion 114*b* is slanted in such a way that forms a greater gap with the peripheral wall 104*b* toward the end thereof. On the other hand, the surface 116 opposite to the fixed make contact 56 protrudes to the extent that prevents the fixed make spring 58 from being plastically deformed as described in relation to the first embodiment. Accordingly, the base protrusion 114 functions to prevent the fixed make spring 58 from being plastically deformed in the same manner as the other embodiments. Since the electromagnetic relay 110 in this variant includes the base protrusion 114 whose tip is slanted toward the interior, a possible accident is prevented, e.g., in the case where a lower end of the peripheral wall 104*b* of the cover 104 is damaged when it comes in contact with an upper end of the base protrusion 114 during a process of assembling the cover 104 and the base 112 together. In other words, since the base protrusion 114 formed on the base 112 has a slanted surface in a manner that the base protrusion 114 becomes gradually thinner in a direction in which the cover 104 and the base 112 are assembled together, the assembling process can be smoothly carried out.

Figure 11:
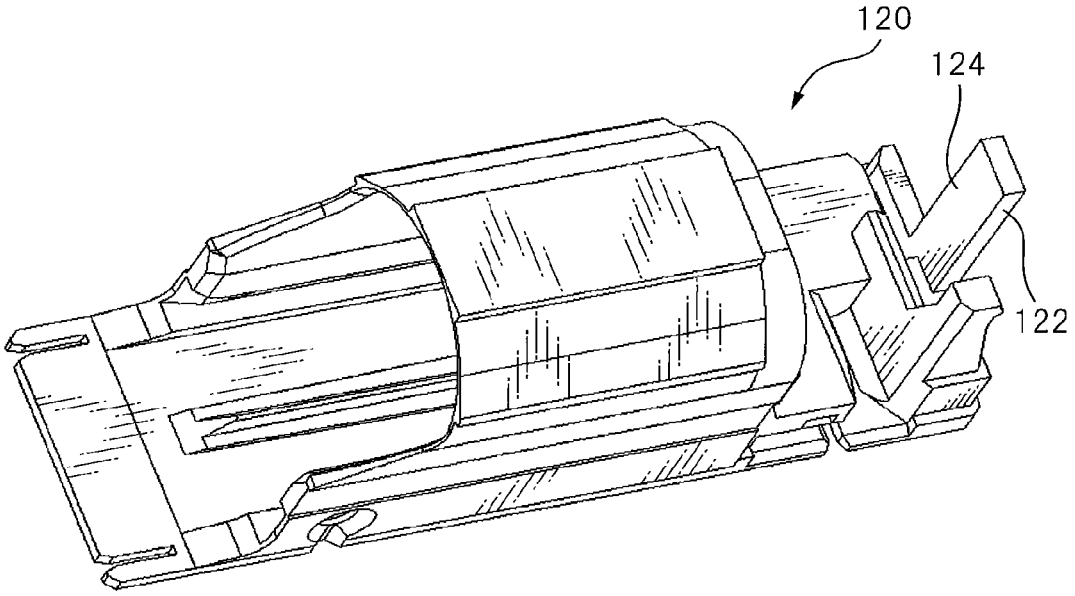
FIG. 11 is a perspective view illustrating a base of the electromagnetic relay according to the second embodiment.
Figure 12:
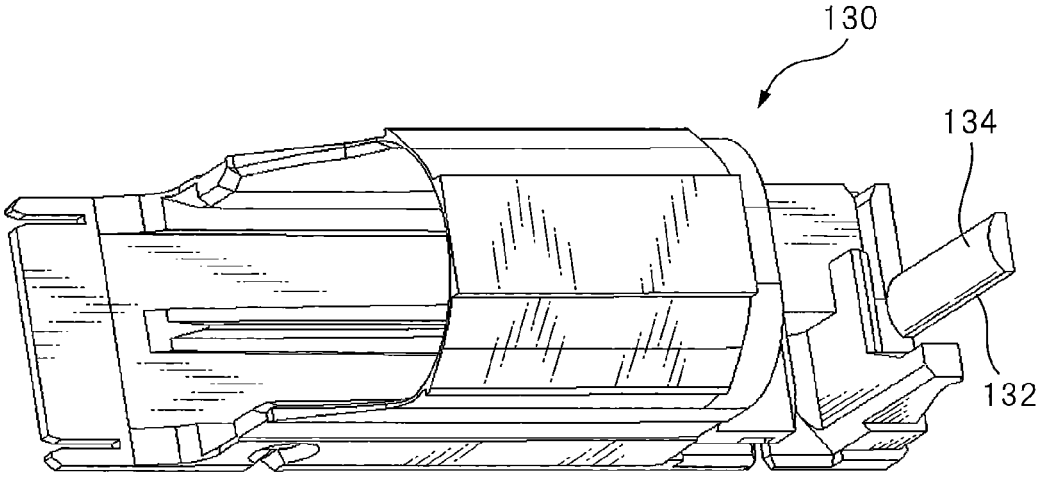
FIG. 12 is a perspective view illustrating a base of an electromagnetic relay according to a variant of the second embodiment.

Referring to FIGS. 11 and 12, exemplary configurations of the surface of the base protrusion opposite to the fixed make contact 56 will be described. FIG. 11 is a perspective view illustrating the base of the electromagnetic relay according to the second embodiment. FIG. 12 is a perspective view illustrating the base of the electromagnetic relay according to a variant of the second embodiment.

The base 120 shown in FIG. 11 includes a base protrusion 122 having a flat surface 124 opposite to the fixed make contact 56. The base protrusion 122 having a rectangular shape in top view as illustrated facilitates a production process of the base protrusion 122, and thus, the electromagnetic relay can also be inexpensive.

The base 130 shown in FIG. 12 includes a base protrusion 132 having a surface 134 opposite to the fixed make contact 56, and the surface 134 of the base protrusion 132 has an arc-shape protruding toward the fixed make contact 56. With such an arc-shaped surface 134, even when the fixed make spring 58 is twisted, for example, which makes difficult for the fixed make contact 56 to come in contact with the surface 134 in a face-to-face manner, the fixed make spring 58 can be prevented from being plastically deformed. In other words, the arc-shaped surface 134 allows the fixed make contact 56 to come in contact with the protrusion 132 in any direction, enhancing reliability of an opening and closing operation of the contact part.

Figure 13:
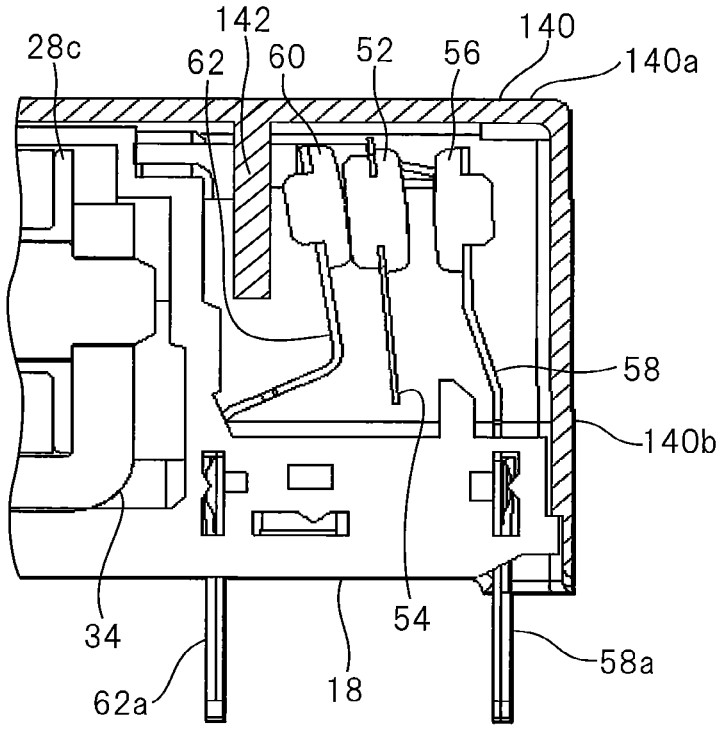
FIG. 13 is a partial sectional view illustrating an electromagnetic relay according to a third embodiment, corresponding to FIG. 6.

FIG. 13 is a partial sectional view illustrating an electromagnetic relay according to a third embodiment, corresponding to FIG. 6. As can been seen in comparison with FIG. 3 or 6, the electromagnetic relay according to this embodiment includes a cover 140 having a protrusion 142 protruding toward the fixed break contact 60, instead of the protrusion 66 or 84 protruding toward the fixed make contact 56. As shown in FIG. 13, the protrusion 142 hangs from an inner surface of a top wall 140*a* of the cover 140 substantially in parallel to a peripheral wall 140*b*. The protrusion 142 protrudes relative to the fixed break contact 60 to the extent that the fixed break spring 62 is prevented from being plastically deformed. Thus, the size of the protrusion 142 protruding relative to the fixed break contact 60 is designed such that the fixed break spring 62 comes in contact with the protrusion 142 within a range that allows the fixed break spring 62 to be elastically deformed.

The size of the protrusion 142 protruding relative to the fixed break contact 60 may also be designed such that in a state where the movable contact 52 is in contact with the fixed break contact 60 (i.e., a state where the electromagnet part 12 is not excited), a side of the fixed break contact 56 opposite to the side facing the movable contact 52 comes in contact with the protrusion 142. In this case, when the movable contact 52 is pressed against the fixed break contact 60 by biasing force, no gap is formed between the fixed break contact 60 and the protrusion 142. This configuration allows the protrusion 142 to absorb unexpected impact thereon caused by, e.g., the electromagnetic relay 10 falling down. Accordingly, the fixed break spring 62 can be prevented from being plastically deformed.

Figure 14:
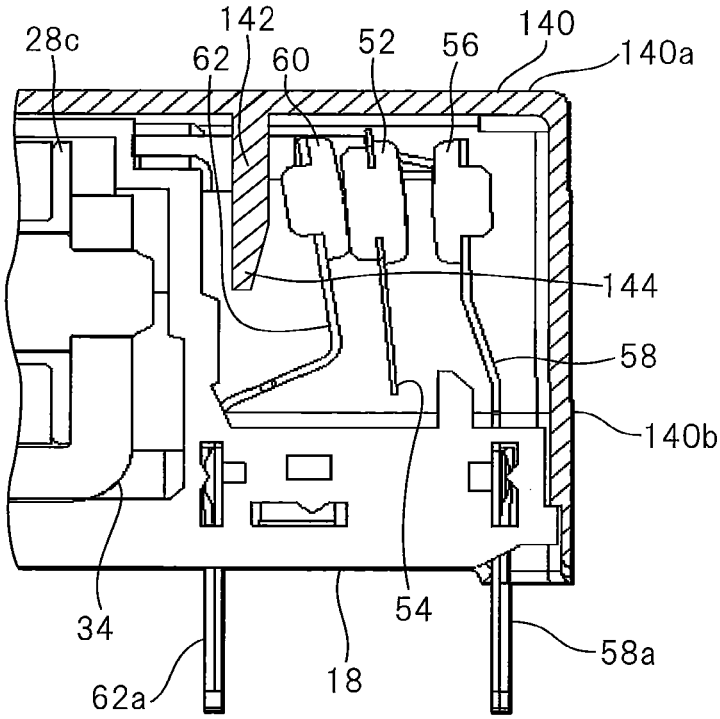
FIG. 14 is a partial sectional view illustrating an electromagnetic relay according to a variant of the third embodiment, corresponding to FIG. 6.

FIG. 14 is a partial sectional view illustrating an electromagnetic relay according to a variant of the third embodiment, corresponding to FIG. 6. In this variant, the protrusion 142 protruding toward the fixed break contact 60 has a slanted portion 144 which is slanted in relation to a surface of the protrusion 142 opposite to the fixed break contact 60. The slanted portion 144 is formed so as to become gradually thinner toward a tip end of the protrusion 142. With the protrusion 142 having the slanted portion 144 formed thereon, the fixed break spring 62 can be prevented from being deformed by accident when the protrusion 142 comes in contact with the fixed break contact 60 during a process of assembling the cover 140 and the base 18 together. Therefore, the assembling process can be smoothly carried out. The shape of the slanted portion 144 as illustrated represents merely one example, and thus the protrusion 142 may also have the slanted portion 144 of different shapes.

Figure 15:
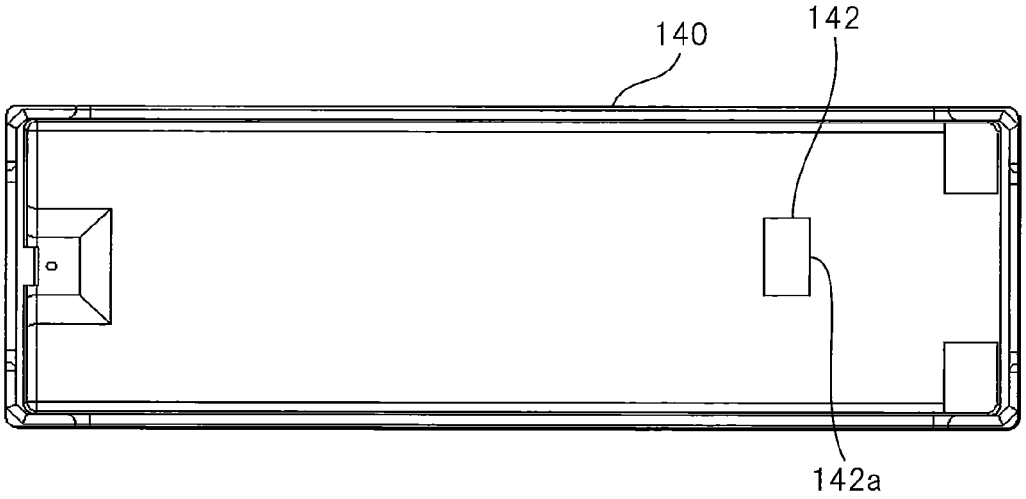
FIG. 15 is a bottom view illustrating a cover of the electromagnetic relay according to the third embodiment.

FIG. 15 is a bottom view illustrating a cover of the electromagnetic relay according to the third embodiment. The protrusion 142 in this embodiment has a flat surface 142*a* opposite to the fixed break contact 60. The protrusion 142 having such a shape facilitates a producing process of the protrusion 142, and therefore the electromagnetic relay can also be inexpensive.

Figure 16:
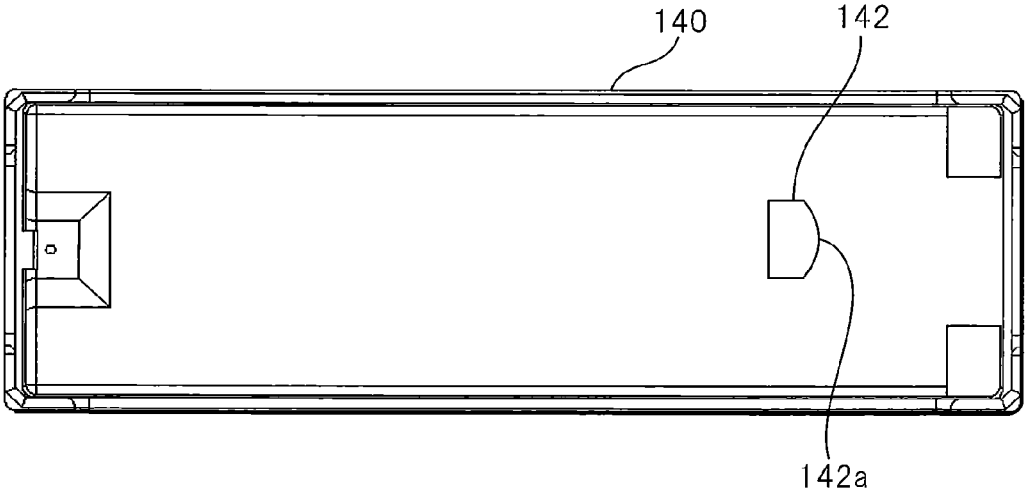
FIG. 16 is a bottom view illustrating a cover of an electromagnetic relay according to another variant of the third embodiment.

FIG. 16 is a bottom view illustrating a cover of the electromagnetic relay according to another variant of the third embodiment. A protrusion 142 in this variant has a surface 142 opposite to the fixed break contact 60 and the surface 142 has an arc-shape protruding toward the fixed break contact 60. With such an arc-shaped surface 142*a*, even when the fixed break spring 62 is twisted, for example, which makes difficult for the fixed break contact 60 to come in contact with the surface 142*a* of the protrusion 142 in a face-to-face manner, the fixed break contact 60 can still come in contact with the protrusion 142. Therefore, the fixed break spring 62 can be prevented from being plastically deformed. In other words, the arc-shaped surface 142*a* allows the fixed break contact 60 to come in contact with the protrusion 142 in any direction, enhancing reliability of an opening and closing operation of the contact part.

Figure 17:
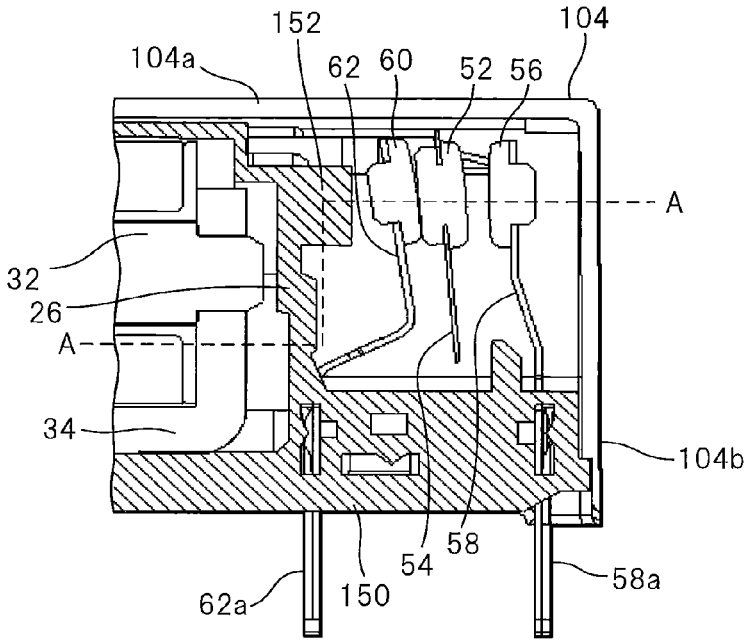
FIG. 17 is a partial sectional view illustrating an electromagnetic relay according to a fourth embodiment, corresponding to FIG. 6.

FIG. 17 is a partial sectional view illustrating an electromagnetic relay according to a fourth embodiment, corresponding to FIG. 6. The electromagnetic relay in this embodiment includes a cover 104 having a top wall 104*a* and a peripheral wall 104*b* in the same manner as a conventional type. A base 150 illustrated with hatching in FIG. 17 has a base protrusion 152 protruding from the base block 26 for electrically insulating the electromagnet part 12 and the contact part 16, toward a side of the fixed break contact 60 opposite to the side facing the movable contact 52. The size of the base protrusion 152 protruding relative to the fixed break contact 60 is designed such that the same effect as that described in relation to the third embodiment can be achieved. Therefore, the present embodiment can prevent the fixed break spring 62 from being plastically deformed, maintaining reliability of an opening and closing operation of the contact part.

Figure 18:
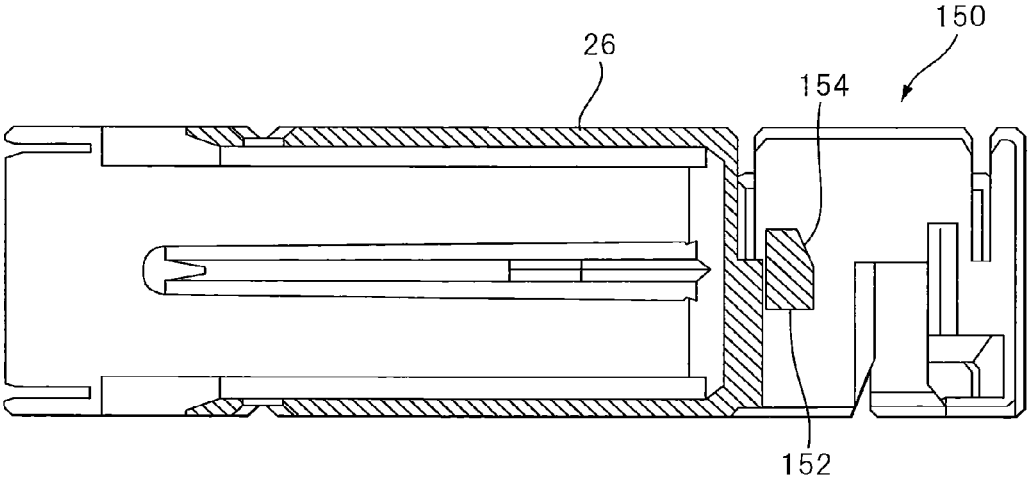
FIG. 18 is a plan view illustrating a base of the electromagnetic relay according to the fourth embodiment with a part of the base cut away.

FIG. 18 is a plan view illustrating the base 150 of the electromagnetic relay according to the fourth embodiment with a part of the base 150 cut away. In FIG. 18, the base 150 is cut along dashed line A-A in FIG. 17. The base protrusion 152 has a slanted portion 154 which becomes gradually thinner in a direction defined along a shorter side of the electromagnetic relay. The slanted portion 154 is oriented in a direction in which the fixed break spring 62 is fitted in position to the base 150. This configuration prevents the base protrusion 152 and the fixed break contact 60 from coming in contact with each other during a process of fitting the fixed break spring 62 to the base 150, thereby preventing the fixed break spring 62 from being damaged. Therefore, the fitting process can be smoothly carried out.

Figure 19:
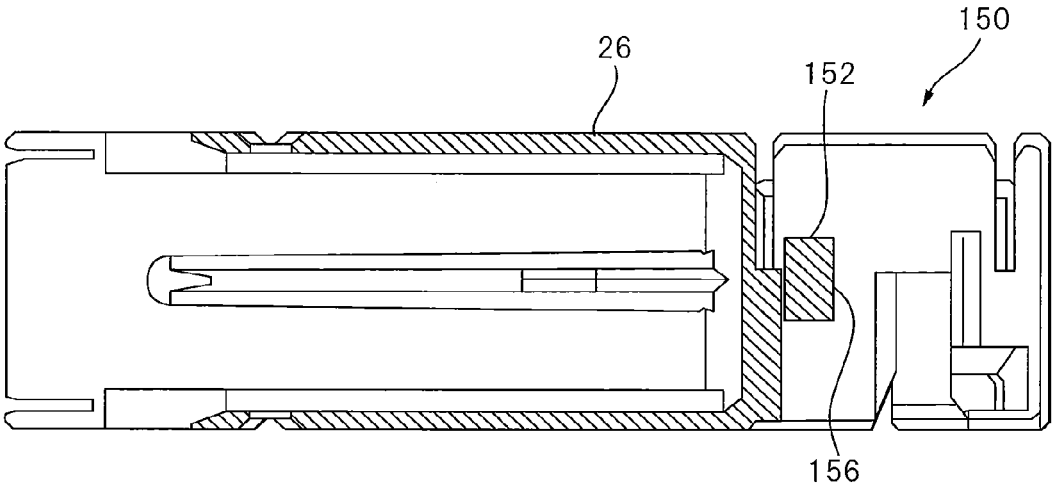
FIG. 19 is a plan view illustrating a base of the electromagnetic relay according to a variant of the fourth embodiment with a part of the base cut away.
Figure 20:
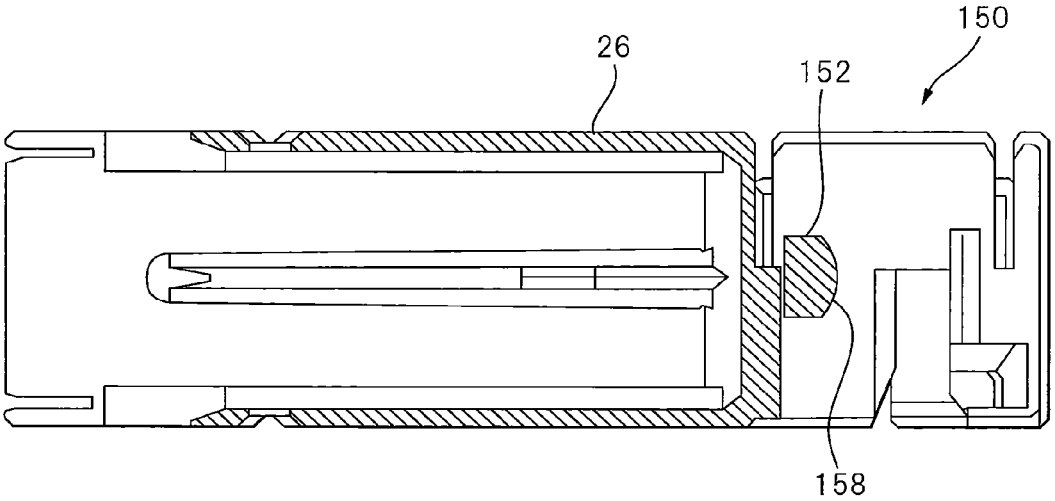
FIG. 20 is a plan view illustrating a base of the electromagnetic relay according to another variant of the fourth embodiment with a part of the base cut away.

Referring to FIGS. 19 and 20, examples of the configuration of a surface of the base protrusion 152 opposite to the fixed break contact 60 will be described. FIG. 19 is a plan view illustrating a base of the electromagnetic relay according to a variant of the fourth embodiment with a part of the base cut away. FIG. 20 is a plan view illustrating a base of the electromagnetic relay according to another variant of the fourth embodiment with a part of the base cut away. In FIGS. 19 and 20, the base 150 is cut along dashed line A-A in FIG. 17, similarly to FIG. 18.

As cane be seen from FIG. 19, the base protrusion 152 formed on the base 150 has a flat surface 156 opposite to the fixed break contact 60. The base protrusion 152 having such a shape facilitates a production process of the protrusion 152, and therefore the electromagnetic relay can also be inexpensive.

The base 150 shown in FIG. 20 has the base protrusion 152 having a surface 158 opposite to the fixed break contact 60 and the surface 158 has an arc-shape protruding toward the fixed break contact 60. With such an arc-shaped surface 158, even when the fixed break spring 62 is twisted, for example, which makes difficult for the fixed break contact 60 to come in contact with the surface 158 in a face-to-face manner, the fixed break spring 62 can be prevented from being plastically deformed. In other words, the arc-shaped surface 158 allows the fixed break contact 60 to come in contact with the protrusion 152 in any direction, enhancing reliability of an opening and closing operation of the contact part.

Although the particular embodiments have been described above, it is needless to say that the scope of the present invention will not be limited to those particularities. For example, the present invention can also be applied to a latch type of electromagnetic relay in which a permanent magnet is provided to the actuator part. In the illustrated embodiments, the protrusions for restricting movement of the fixed make spring or the fixed break spring are integrally formed to the base or cover of the electromagnetic relay. However, the protrusion may also be a separate part adhered to the base or cover.

In the embodiments, for the illustrative purpose, the protrusion is provided either on the side closer to the fixed make contact or on the side closer to the fixed break contact. However, it is also possible to provide both of the protrusions protruding toward the fixed make contact and toward the fixed break contact. This configuration prevents both the fixed make spring and the fixed break spring from being plastically deformed.

What is claimed is:

1. An electromagnetic relay comprising:

an electromagnet;

an actuator which is actuated in response to a magnetic action of the electromagnet;

a contact which opens and closes in response to the actuation of the actuator; and a housing for accommodating the electromagnet, the actuator and the contact, wherein the contact includes a movable spring having a base end fixed to a bottom of the housing and a tip end provided with a movable contact, and a fixed spring having a base end fixed to the bottom of the housing and a tip end provided with a fixed contact, the movable contact being provided opposite to the fixed contact and being moved in response to the actuation of the actuator, coming in contact with the fixed contact or moving away from the fixed contact, wherein the housing has a base and a cover with a top and sides, each side extending from the top of the cover to a base end in contact with the base, one side of the cover having a protrusion, disposed closer to the top of the cover than a midpoint between the base end and the top, protruding inward toward the fixed contact which is closer to the cover than the movable contact, and wherein the fixed spring includes a portion inclining relative to a protrusion side of the cover on which the protrusion is formed, thereby preventing the tip end of the fixed spring from touching the protrusion when the contact is open.

2. The electromagnetic relay according to claim 1, wherein the protrusion is configured such that the protrusion comes in contact with the fixed contact as a result of elastic deformation of the fixed spring.

3. The electromagnetic relay according to claim 1, wherein the protrusion is configured such that the protrusion comes in contact with a side of the fixed contact opposite to a side facing the movable contact when the movable contact comes in contact with the fixed contact to close the contact.

4. The electromagnetic relay according to claim 1, wherein the protrusion has a flat surface facing the fixed contact.

5. The electromagnetic relay according to claim 1, wherein the protrusion has a surface facing the fixed contact, the surface having an arc-shape protruding toward the fixed contact.

6. The electromagnetic relay according to claim 1, wherein the base holds the electromagnet, the actuator and the contact, and the cover is fitted to the base at the base end of the sides of the cover, the protrusion being integrally formed into the cover.

7. The electromagnetic relay according to claim 1, wherein the contact includes a first fixed spring provided with a fixed make contact and a second fixed spring provided with a fixed break contact, the protrusion protruding toward a side of the fixed make contact opposite to a side of the fixed make contact facing the movable contact or toward a side of the fixed break contact opposite to a side of the fixed break contact facing the movable contact.

8. The electromagnetic relay according to claim 1, wherein the fixed spring comprises an intermediate portion extending between the base end and the tip end, the base end and the tip end extending parallel to the protrusion side of the cover, the intermediate portion inclining relative to the protrusion side of the cover.

9. The electromagnetic relay according to claim 1, wherein the fixed spring leans away from the protrusion side of the cover.

10. An electromagnetic relay comprising:

an electromagnet;

an actuator which is actuated in response to a magnetic action of the electromagnet;

a contact which opens and closes in response to the actuation of the actuator; and a housing for accommodating the electromagnet, the actuator and the contact, wherein the contact includes a movable spring having a base end fixed to a bottom of the housing and a tip end provided with a movable contact, and a fixed spring having a base end fixed to the bottom of the housing and a tip end provided with a fixed contact, the movable contact being provided opposite to the fixed contact and being moved in response to the actuation of the actuator, coming in contact with the fixed contact or moving away from the fixed contact, wherein the housing has a base with at least one top surface and a cover with a top above the at least one top surface of the base and sidewalls with base portions in contact with the base, a first sidewall of the cover having first and second protrusions, the first protrusion disposed nearer to the base than the second protrusion, the second protrusion protruding toward a side of the fixed contact opposite to a side of the fixed contact facing the movable contact, and wherein the fixed spring includes a portion inclining relative to the first sidewall, thereby preventing the tip end of the fixed spring from touching the protrusion when the contact is open.

11. The electromagnetic relay according to claim 10, wherein the second protrusion has a slanted surface such that the second protrusion becomes gradually thinner from a position nearer the top of the cover toward a position nearer the base.

12. The electromagnetic relay according to claim 10, wherein the second protrusion varies in thickness, whereby a distance between the one side of the cover and a side of the fixed contact closest to the fixed contact and substantially parallel to the outside wall of the cover, is not constant.

13. The electromagnetic relay according to claim 10, wherein the fixed spring comprises a base part having the base end, a tip part having the tip end, and an intermediate part extending between the base part and the tip art, the base part and the tip part extending parallel to the first sidewall, the intermediate part inclining relative to the first sidewall.

14. The electromagnetic relay according to claim 10, wherein the fixed spring leans away from the first sidewall.

15. An electromagnetic relay comprising:

an electromagnet;

an actuator which is actuated in response to a magnetic action of the electromagnet;

a contact which opens and closes in response to actuation of the actuator; and a housing accommodating the electromagnet, the actuator and the contact, wherein the contact includes:

a movable spring provided with a movable contact and having a base end fixed to the housing; and a fixed spring provided with a fixed contact and having a base end fixed to the housing, the movable contact being moved in response to the actuation of the actuator to come in contact with a first side of the fixed contact or move away from the fixed contact, and the housing having a protrusion protruding toward a second side of the fixed contact opposite to the first side of the fixed contact, so as to prevent the fixed spring from being plastically deformed.

16. The electromagnetic relay according to claim 15, wherein the protrusion is configured such that the protrusion comes in contact with the first side of the fixed contact when the fixed spring elastically deforms as the fixed contact contacts the movable contact.

* * * * *